US011440333B2

(12) United States Patent
Fujita

(10) Patent No.: US 11,440,333 B2
(45) Date of Patent: Sep. 13, 2022

(54) PRINTING SYSTEM

(71) Applicant: Brother Kogyo Kabushiki Kaisha, Aichi-Ken (JP)

(72) Inventor: Keisuke Fujita, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/239,063

(22) Filed: Apr. 23, 2021

(65) Prior Publication Data

US 2021/0237473 A1 Aug. 5, 2021

Related U.S. Application Data

(63) Continuation of application No. 16/669,946, filed on Oct. 31, 2019, now Pat. No. 11,014,373.

(30) Foreign Application Priority Data

Oct. 31, 2018 (JP) ..... JP2018-205898

(51) Int. Cl.
*B41J 2/325* (2006.01)

(52) U.S. Cl.
CPC ..... *B41J 2/325* (2013.01)

(58) Field of Classification Search
CPC ..... B41J 2/325
See application file for complete search history.

(56) References Cited

U.S. PATENT DOCUMENTS

2011/0220994 A1 9/2011 Parekh et al.
2013/0050759 A1 2/2013 Tsuchiya
2013/0215210 A1 8/2013 McNestry et al.
2014/0036019 A1 2/2014 Mori
(Continued)

FOREIGN PATENT DOCUMENTS

CN 102970454 A 3/2013
CN 103930280 A 7/2014
(Continued)

OTHER PUBLICATIONS

Sep. 2, 2021—(EP) Extended EP Search Report—App 21180016.4.
(Continued)

*Primary Examiner* — Justin Seo
(74) *Attorney, Agent, or Firm* — Banner & Witcoff, Ltd.

(57) ABSTRACT

A printing system includes a printing device, a platen roller, a controller, and an interface. The printing device includes a thermal head, a ribbon drive source, and a head drive source. When receiving a print command, the controller executes head movement control for moving the thermal head and ribbon acceleration control for accelerating a transport speed of an ink ribbon to a target speed. After completion of the head movement control and the ribbon acceleration control, the controller is configured to control the thermal head to perform printing on the print medium. At least before receiving the print command, the controller is configured to determine a printable distance over which the print medium is transported from the reception of the print command till the completion of the head movement control and the ribbon acceleration control and outputs the determined printable distance through the interface.

3 Claims, 10 Drawing Sheets

(56) References Cited

U.S. PATENT DOCUMENTS

| | | | | |
|---|---|---|---|---|
| 2014/0231894 | A1 | 8/2014 | Parekh et al. | |
| 2016/0167362 | A1 | 6/2016 | Tsuno et al. | |
| 2016/0185126 | A1* | 6/2016 | McNestry | B41J 35/36 347/213 |
| 2017/0177283 | A1 | 6/2017 | Tsuchiya | |
| 2018/0056687 | A1 | 3/2018 | Matsuda | |

FOREIGN PATENT DOCUMENTS

| | | | | |
|---|---|---|---|---|
| CN | 106183466 | A | | 12/2016 |
| FR | 2783460 | A1 | | 3/2000 |
| JP | H10-016345 | A | | 1/1998 |
| JP | 2001225537 | A | * | 8/2001 |
| JP | 2001225537 | A | | 8/2001 |
| JP | 2010-036425 | A | | 2/2010 |
| JP | 2013-049281 | A | | 3/2013 |

OTHER PUBLICATIONS

Feb. 26, 2020—(EP) Extended Search Report—App 19206286.7.
Sep. 22, 2020—(CN) Notification of First Office Action—App 201911042542.4, Eng Tran.
May 6, 2022—(CN) Notification of First Office Action—CN App No. 202110805434.9, Eng Tran.

* cited by examiner

FIG. 7

30

| RIBBON SPEED Vr / RIBBON TYPE | 100mm/sec | 200mm/sec | 300mm/sec | 400mm/sec | 500mm/sec | 600mm/sec | 700mm/sec | 800mm/sec | ··· |
|---|---|---|---|---|---|---|---|---|---|
| WIDTH: 100mm LENGTH: 1000m | 0.20 sec | 0.24 sec | 0.28 sec | 0.32 sec | 0.36 sec | 0.40 sec | 0.44 sec | 0.48 sec | ··· |
| WIDTH: 100mm LENGTH: 500m | 0.15 sec | 0.18 sec | 0.21 sec | 0.24 sec | 0.27 sec | 0.30 sec | 0.33 sec | 0.36 sec | ··· |
| WIDTH: 50mm LENGTH: 1000m | 0.10 sec | 0.12 sec | 0.14 sec | 0.16 sec | 0.18 sec | 0.20 sec | 0.22 sec | 0.24 sec | ··· |
| WIDTH: 50mm LENGTH: 500m | 0.05 sec | 0.06 sec | 0.07 sec | 0.08 sec | 0.09 sec | 0.10 sec | 0.11 sec | 0.12 sec | ··· |
| ··· | ··· | ··· | ··· | ··· | ··· | ··· | ··· | ··· | ··· |

FIG. 8

40

| HEAD SPEED SETTING | HEAD SPEED Vh |
|---|---|
| FAST | 100 mm/sec |
| NORMAL | 50 mm/sec |
| SLOW | 10 mm/sec |

PRINTING SYSTEM

CROSS-REFERENCE TO RELATED APPLICATIONS

This application is a Continuation of application Ser. No. 16/669,946 filed on Oct. 31, 2019, which application is based on Japanese Patent Applications No. 2018-205898 filed on Oct. 31, 2018, the entire contents of which are incorporated herein by reference.

TECHNICAL FIELD

The present invention relates to a printing system and a printing system control method.

BACKGROUND

A thermal printer which performs printing on a print medium by heating an ink ribbon with a thermal head is known. For example, thermal printers of JP-A-2010-36425 and JP-A-2013-49281 are provided with a head unit including a head, a bracket, and a head drive unit. A plurality of heating elements are disposed at a chamfered end portion of the head. The bracket fixes the head. The head drive unit rotates the head and the bracket around a predetermined rotation axis. The head unit is disposed in the vicinity of the ribbon transported in a printing section. The head drive unit rotates the head fixed to the bracket from an initial position positioned inside a main body to a print position positioned outside the main body. The head located in the print position performs printing on a packaging film, which is a print medium, using the ribbon in contact with the head.

The printers exemplified in JP-A-2010-36425 and JP-A-2013-49281 need to execute acceleration of the ribbon and movement of the head from the reception of a print command to the start of printing. While the acceleration of the ribbon and the movement of the head are being performed, transport of the print medium is continued. The printer which has received the print command can perform printing on the print medium being transported when acceleration of the ribbon and movement of the head are completed. Accordingly, the printer cannot start printing when receiving a print command, and can start printing when the acceleration of the ribbon and the movement of the head are completed. A shortest transport distance of the print medium from when the printer receives the print command to when the printer can actually print is referred to as a shortest preparation distance. The shortest preparation distance is determined by the time required for the acceleration of the ribbon and the movement of the head, and a transport speed of the print medium within the required time.

It is assumed that the printer as described above is equipped with a function that allows the user to arbitrarily set the distance for transporting the print medium from issuance of the print command to the start of printing. However, when the set distance is less than the shortest preparation distance, the acceleration of the ribbon and the movement of the head have not been completed when the print medium has been transported by the set distance, and thus the printer cannot perform printing and generates an error. When such an error occurs, the user may have to set the distance again.

An object of the present invention is to provide a printing system capable of suppressing that the user has to set the distance again.

SUMMARY

According to an aspect of the invention, a printing system includes:

a printing device that includes:

a thermal head, a ribbon drive source that is configured to transport an ink ribbon through a space between the thermal head and a platen roller; and a head drive source that is configured to move the thermal head in a direction approaching or separating from the platen roller, the platen roller that is disposed opposite to the ink ribbon with respect to a transport path of a print medium transported by an external apparatus;

a controller; and an interface, wherein the head drive source is configured to move the thermal head between a first position at which the ink ribbon is urged toward the platen roller and a second position which is farther away from the platen roller than the first position and at which urging of the ink ribbon against the platen roller is released, and when receiving a print command, the controller is configured to execute head movement control for moving the thermal head from the second position to the first position with the head drive source and ribbon acceleration control for accelerating a transport speed of the ink ribbon to a target speed with the ribbon drive source.

After completion of the head movement control and the ribbon acceleration control, the controller is configured to control the thermal head located at the first position to perform printing on the print medium, which is being transported and is disposed between the ink ribbon and the platen roller, using the ink ribbon transported at the target speed with the ribbon drive source.

At least before receiving the print command, the controller is configured to determine a printable distance over which the print medium is transported from the reception of the print command till the completion of the head movement control and the ribbon acceleration control and outputs the determined printable distance through the interface.

BRIEF DESCRIPTION OF DRAWINGS

FIG. 7 is a diagram for explaining an acceleration time table;

FIG. 8 is a diagram for explaining a head movement speed table;

DETAILED DESCRIPTION OF EMBODIMENTS

<Overview of Printing System 8>

One embodiment of the present invention will be described with reference to the drawings. A printing system 8 is a system for performing thermal transfer printing. The printing system 8 performs printing on a print medium P transported by an external apparatus 100 (see FIG. 2). A specific example of the external apparatus 100 is a packaging machine that transports a packaging material. In this case, for example, the printing system 8 is used by being incorporated into a part of a transport line on which the print medium P is transported by the packaging machine.

Figure 1:
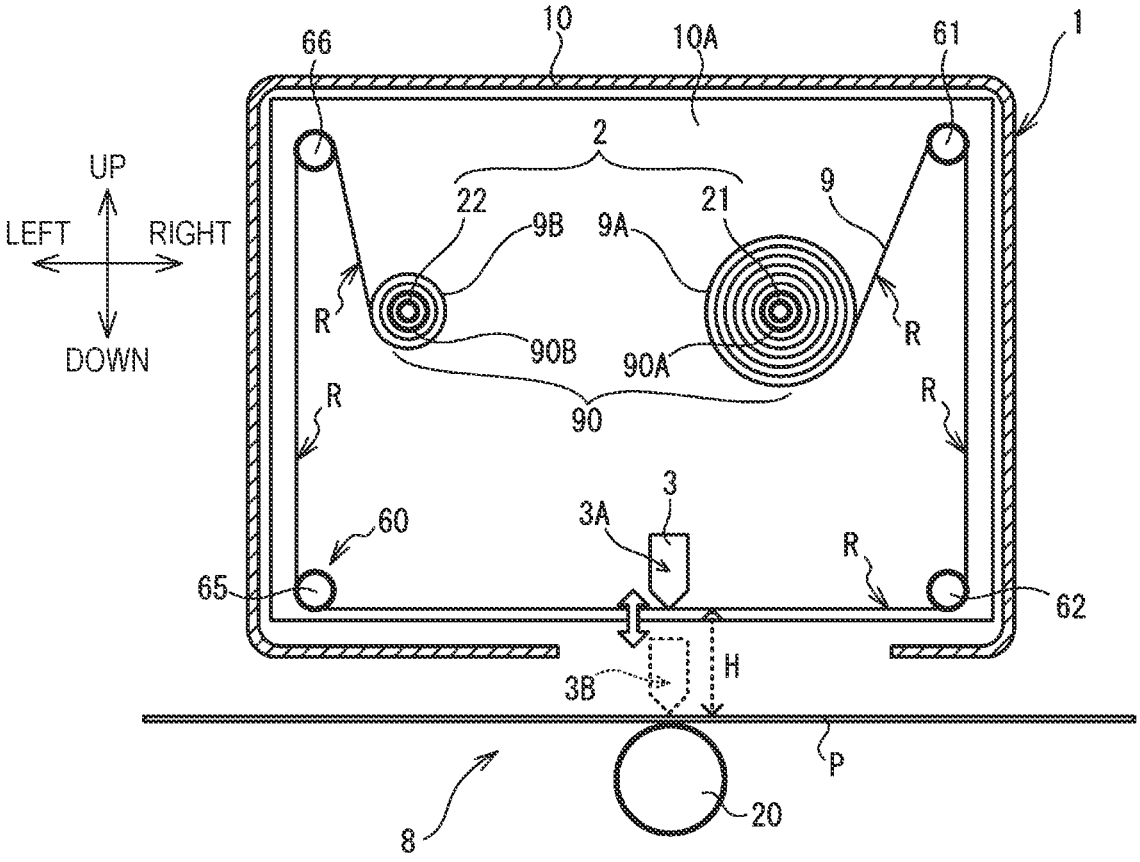
FIG. 1 is a diagram illustrating an overview of a printing system.
Figure 2:
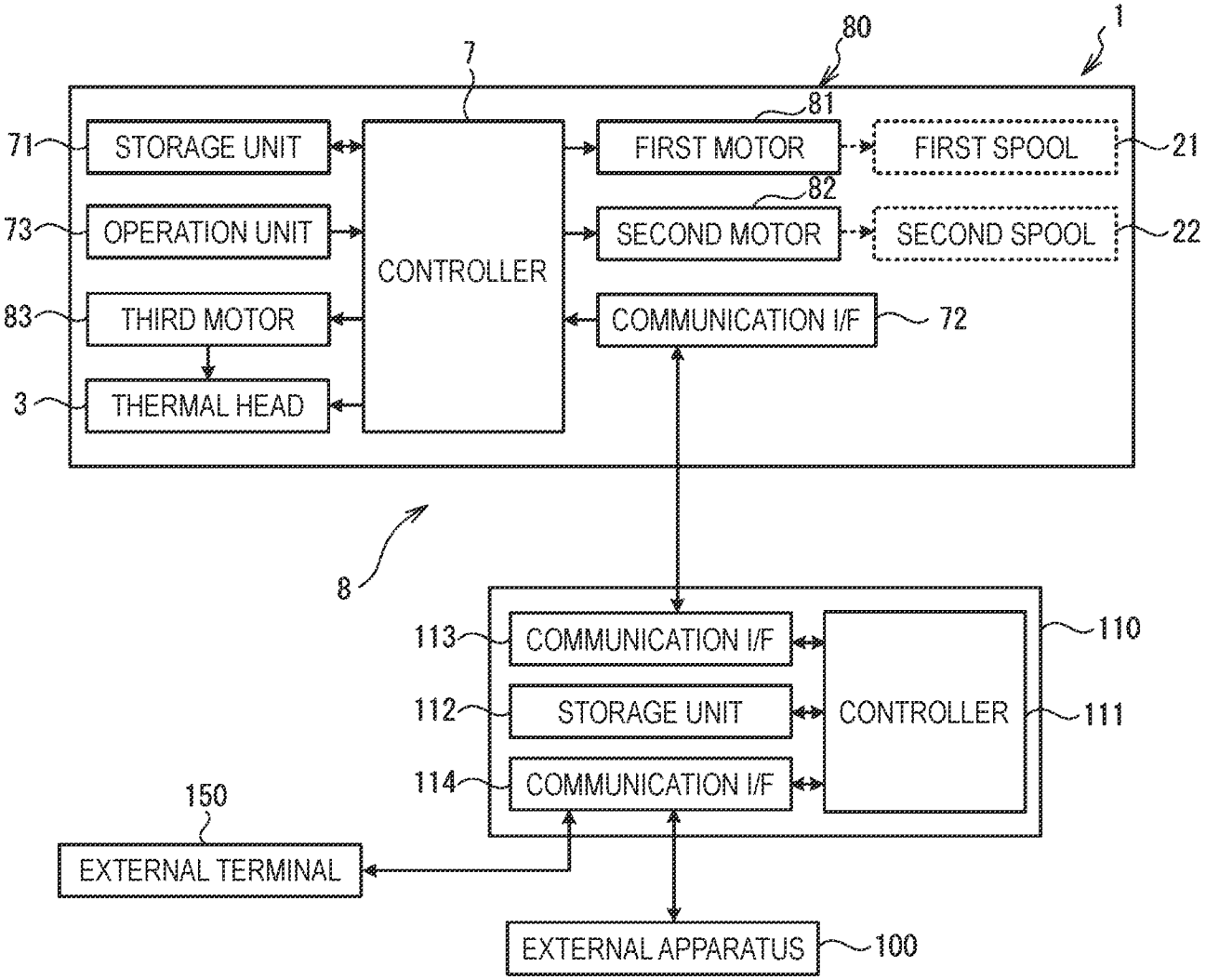
FIG. 2 is a block diagram illustrating an electrical configuration of the printing system.

As illustrated in FIG. 1, the printing system 8 includes a printing device 1, controllers 7 and 111 (see FIG. 2), a platen roller 20, and an inter-apparatus controller 110 (see FIG. 2). Hereinafter, in order to help understanding of the description of the drawings, above, below, the left, the right, the front, and the rear of the printing system 1 will be defined. The above, the below, the left, the right, the front, and the rear of the printing device 1 correspond to an upper side, a lower side, a left side, a right side, a front side, and a rear side of FIG. 1, respectively. In FIG. 1, a transport direction of the print medium P coincides with the horizontal direction. The print medium P is transported by the external apparatus 100 from the right to the left.

The printing device 1 is a thermal transfer type thermal printer. The printing device 1 includes a thermal head 3, a first motor 81, a second motor 82, and a third motor 83 (see FIG. 2). As illustrated in FIG. 1, the printing device 1 includes a box-like casing 10. A substrate 10A is fixed inside the casing 10. A ribbon attachment portion 2, the thermal head 3, a guide shaft 60, a controller 7 (see FIG. 2), and a motor 80 (see FIG. 2) are provided on the substrate 10A. The guide shaft 60 is a general term of guide shafts 61, 62, 65, and 66. The motor 80 is a general term of a first motor 81, a second motor 82, and a third motor 83.

A cylindrical platen roller 20 is disposed below the printing device 1. The thermal head 3 and the platen roller 20 face each other in the vertical direction. The first motor 81 and the second motor 82 (see FIG. 2) transport an ink ribbon 9 through a space between the thermal head 3 and the platen roller 20. The printing device 1 is adjacent to the print medium P in a state where the lower end of the printing device 1 faces a printing surface (surface on the upper side in FIG. 1) of the print medium P. The print medium P transported by the external apparatus passes between the ink ribbon 9 and the platen roller 20. That is, the platen roller 20 is disposed opposite to the ink ribbon 9 with respect to the transport path of the print medium P transported by the external apparatus.

<Ribbon Assembly 90>

The printing device 1 performs printing on the print medium P by heating the ink ribbon 9 of the ribbon assembly 90 accommodated inside the casing 10 with the thermal head 3. The ribbon assembly 90 has core shafts 90A and 90B and the ink ribbon 9. The core shafts 90A and 90B are each cylindrical. The ink ribbon 9 is a belt-like film, and an ink layer is applied to the surface of a base material including polyethylene terephthalate (PET). The ink layer contains, for example, a pigment component including carbon and a binder component including wax and/or resin. Ink is melted by heating and transferred to the print medium P. The ink ribbon 9 may have functional layers including a back coat layer, a release layer, and an adhesive layer, as necessary. One end of the ink ribbon 9 is connected to the side surface of the core shaft 90A, and the other end is connected to the side surface of the core shaft 90B.

The ribbon assembly 90 is attached to the ribbon attachment portion 2 of the printing device 1 in a state where the ink ribbon 9 is wound around the core shaft 90A. The ink ribbon 9 wound around the core shaft 90A is referred to as a "supply roll 9A". In the process of printing by the thermal head 3, the ink ribbon 9 is fed from the supply roll 9A of the core shaft 90A, is guided by the guide shaft 60 and the thermal head 3, and is wound around the core shaft 90B. The ink ribbon 9 wound around the core shaft 90B is referred to as a "winding roll 9B".

<Ribbon Attachment Portion 2>

The ribbon attachment portion 2 includes a first spool 21 and a second spool 22. Each of the first spool 21 and the second spool 22 is rotatable about a rotation axis extending in the front-and-rear direction. The first spool 21 is provided substantially at the center in the vertical direction of the substrate 10A and on the right side of the center in the horizontal direction. The second spool 22 is provided substantially at the center in the vertical direction of the substrate 10A and on the left side of the center in the horizontal direction. The supply roll 9A wound around the core shaft 90A of the ribbon assembly 90 is attached to the first spool 21. The winding roll 9B wound around the core shaft 90B of the ribbon assembly 90 is attached to the second spool 22.

The first spool 21 is directly connected to the first motor 81 (see FIG. 2) and is rotated by the first motor 81. The second spool 22 is directly connected to the second motor 82 (see FIG. 2) and is rotated by the second motor 82. Since being rotated by different motors 80, respectively, the first and second spools 21 and 22 can rotate at different rotational speeds. The first spool 21 and the second spool may be indirectly connected to the first motor 81 and the second motor 82, respectively.

When the first spool 21 and the second spool 22 rotate counterclockwise in a state where the printing device 1 in FIG. 1 is viewed from the front side, the core shafts 90A and 90B rotate in a normal rotation direction. In this case, the ink ribbon 9 is fed from the supply roll 9A and wound around the winding roll 9B. When the first spool 21 and the second spool 22 rotate clockwise in a state where the printing device 1 in FIG. 1 is viewed from the front side, the core shafts 90A and 90B rotate in a reverse rotation direction. The ink ribbon 9 is fed from the winding roll 9B and wound around the supply roll 9A.

The ink ribbon 9 stretched between the supply roll 9A and the winding roll 9B is transported in the casing 10 according to the rotation of the first spool 21 and the second spool 22. A path through which the ink ribbon 9 is transported is referred to as a "transport path R". The ink ribbon 9 is transported and guided along the transport path R by coming into contact with the guide shaft 60. The thermal head 3 is adjacent to the ink ribbon 9 stretched between the supply roll 9A and the winding roll 9B.

<Thermal Head 3>

The thermal head 3 is provided below the first spool 21 and the second spool 22 on the front surface of the substrate 10A. The thermal head 3 is provided at a part of the transport direction of the ink ribbon 9. The thermal head 3 includes a plurality of heating elements linearly arranged in the front-and-rear direction. The front-and-rear direction is a direction corresponding to the width direction of the ink ribbon 9, which is a direction intersecting the transport direction of the ink ribbon 9. The thermal head 3 performs printing using a partial area of the ink ribbon 9 by causing a part of the heating elements facing the partial area of the ink ribbon 9 used for printing, of the plurality of heating elements arranged in the width direction of the ink ribbon 9, to generate heat.

The thermal head 3 is movable between head positions 3A and 3B. The head position 3A is a position at which the thermal head 3 is disposed above the lower end portion of the casing 10. The head position 3B is a position at which the thermal head 3 is disposed below the lower end portion of the casing 10. The head positions 3A and 3B are respectively disposed substantially at the center in the horizontal direction of the casing 10 and arranged in the vertical direction. The third motor 83 (see FIG. 2) moves the thermal head 3 in the vertical direction between the head positions 3A and 3B. The head position 3B is a position at which the ink ribbon 9 is urged toward the platen roller 20. The head position 3A is a position which is farther away from the platen roller 20 than the head position 3B and at which urging of the ink ribbon 9 against the platen roller 20 is released. That is, the third motor 83 moves the thermal head 3 in a direction approaching and separating from the platen roller 20.

<Guide Shaft 60>

The guide shaft 60 is cylindrical and extends from the front surface, which is the surface of the substrate 10A, toward the front side. The guide shaft 60 is rotatable around a rotation axis extending in the front-and-rear direction. The guide shaft 61 is provided near the upper right corner of the substrate 10A. The guide shaft 62 is provided near the lower right corner of the substrate 10A. The guide shaft 65 is provided near the lower left corner of the substrate 10A. The guide shaft 66 is provided near the upper left corner of the substrate 10A.

The ink ribbon 9 contacts a part of a circumferential surface of the guide shaft 60. The transport path R of the ink ribbon 9 extends from the supply roll 9A attached to the first spool 21 obliquely upward toward the right, contacts the guide shaft 61 to change its direction, extends downward toward the guide shaft 62, contacts the guide shaft 62 to change its direction, and extends leftward toward the guide shaft 65. The transport path R of the ink ribbon 9 is changed in direction according to contact with the thermal head 3 at a midway portion between the guide shaft 62 and the guide shaft 65. The transport path R of the ink ribbon 9 further contacts the guide shaft 65 to change its direction, extends upward toward the guide shaft 66, contacts the guide shaft 66 to change its direction, and extends obliquely downward to the right toward the winding roll 9B. At least the guide shafts 61, 62, 65, and 66 may be provided in the printing apparatus 1. For example, another guide shaft that changes the direction of the transport path R may be provided between the guide shaft 62 and the guide shaft 65.

<Electric Configuration of Printing System 8>

An electrical configuration of the printing system 8 will be described with reference to FIG. 2. The printing device 1 includes a controller 7. The controller 7 includes a CPU that controls the printing device 1 and various drive circuits that operate according to an instruction of the CPU. Various drive circuits includes, for example, a circuit for supplying a signal (for example, a drive current) to the first motor 81, the second motor 82, and the third motor 83, which are the motors 80, a circuit for supplying a signal (for example, drive current) to the thermal head 3, and the like. The controller 7 is electrically connected to a storage unit 71, an operation unit 73, the thermal head 3, the first motor 81, the second motor 82, and the third motor 83, which are the motors 80, and a communication interface (communication I/F) 72 through an interface circuit (not illustrated).

The thermal head 3 generates heat in response to a signal output from the controller 7. The motor 80 is a stepping motor that rotates in synchronization with a pulse signal. The first motor 81 rotates the first spool 21 according to the pulse signal output from the controller 7. The second motor 82 rotates the second spool 22 according to the pulse signal output from the controller 7. The third motor 83 rotates according to the pulse signal output from the controller 7 to move the thermal head 3. A communication I/F 72 is an interface element for communicating with the inter-apparatus controller 110.

The inter-apparatus controller 110 is provided outside the printing device 1 and controls communication between the printing device 1 and an external apparatus. The inter-apparatus controller 110 includes a controller 111, a storage unit 112, a communication I/F 113, and a communication I/F 114. The communication I/F 113 is connected to the communication I/F 72 of the printing device 1 in a wired or wireless manner. The communication I/F 114 is connected to the external apparatus 100 and an external terminal 150, which are external apparatuses, in a wired or wireless manner. In this embodiment, the external apparatus 100 is an apparatus (for example, a packaging machine for transporting a packaging material) for transporting the print medium P. The external terminal 150 is a terminal (for example, a PC) that allows a user to issue various instructions to the printing apparatus 1.

The storage unit 71 of the printing device 1 includes various storage media including as a ROM, a RAM, and a flash memory. The storage unit 71 stores a program of a process executed by the controller 7. The storage unit 71 stores print data, a medium speed V, setting information, an acceleration time table 30 (see FIG. 7), a head movement speed table 40 (see FIG. 8), and the like. The print data, the medium speed V, and the setting information are set in the storage unit 71 by being input from the external apparatus 100 or the external terminal 150 to the controller 7 through the inter-apparatus controller 110. The setting information includes a ribbon type and head speed setting. The ribbon type is a type of the ink ribbon 9, for example, a width and a length of the ink ribbon 9. The head speed setting is setting information of a movement speed of the thermal head 3. The acceleration time table 30 (see FIG. 7) and the head movement speed table 40 (see FIG. 8) are stored in advance in the storage unit 71.

The program executed by the controller 7 may be downloaded from, for example, the external terminal 150 through the communication I/F 72. The controller 7 may store the program acquired from the external terminal 150 in the storage unit 71 through the communication I/F 72. The print data, the medium speed V, and the setting information may be input from the operation unit 73 of the printing device 1 and set in the storage unit 71.

<Overview of Printing Operation>

An overview of a printing operation in which a plurality of blocks of print images are formed on the print medium P in the printing system 8 will be described with reference to FIG. 3. For ease of understanding, in (a) to (e) of FIG. 3, the ink ribbon 9 and the print medium P are illustrated in a straight line and are separated from each other. However, in practice, the ink ribbon 9 and the print medium P may be bent. The ink ribbon 9 and the print medium P contact each other at a position at which at least the thermal head 3 contacts the ink ribbon 9.

In the printing system 8, the print medium P is transported by the external apparatus 100 (see FIG. 2) at the medium speed V which is the transport speed set by the external apparatus 100. In a state where the print medium P is being transported at the medium speed V, the printing operation by the printing device 1 is executed. The external apparatus 100 transmits a print command to the printing device 1 at a predetermined timing through the inter-apparatus controller 110. In this example, each time a print image of one block is formed on the print medium P, the external apparatus 100 transmits the next print command to the printing device 1. In the printing device 1, when the print command is received from the external apparatus 100, head lowering control and ribbon acceleration control are executed while the print medium P is transported by a predetermined preparation distance L.

The preparation distance L in this embodiment is a set value of the distance for transporting the print medium P from the issuance of the print command to the start of printing, and can be arbitrarily set in the external apparatus 100 or the external terminal 150 by the user. The print command transmitted from the external apparatus 100 to the printing device 1 also includes information for instructing the preparation distance L. When the preparation distance L is set in the external terminal 150, the inter-apparatus controller 110 includes information for instructing the preparation distance L set in the external terminal 150 in the print command output from the external apparatus 100 and transmits the print command to the printing device 1. Accordingly, when the print command is received, the printing device 1 starts printing by the thermal head 3 when the print medium P has been transported by the preparation distance L from the time of reception of the print command FIG. 3 illustrates a case where a distance (that is, the printable distance described later) over which the print medium P is transported until the head lowering control and the ribbon acceleration control are completed is equal to the preparation distance L instructed by the print command.

In the head lowering control, the thermal head 3 is moved from the head position 3A to the head position 3B at a head speed Vh (see FIG. 8) corresponding to the head speed setting set in the storage unit 71. With this configuration, the thermal head 3 approaches the platen roller 20 from above, and urges the ink ribbon 9 to the printing surface of the print medium P. The platen roller 20 contacts the surface of the print medium P opposite to the print surface, and urges the ink ribbon 9 and the print medium P to the thermal head 3.

In the ribbon acceleration control, the first motor 81 and the second motor 82 are driven and the first spool 21 and the second spool 22 rotate. The ink ribbon 9 is fed from the supply roll 9A of the first spool 21 and wound around the winding roll 9B of the second spool 22. Then, the transport speed of the ink ribbon 9 is accelerated from zero to a ribbon speed Yr. The ribbon speed Vr is a target speed of the ink ribbon 9 according to the medium speed V set from the external apparatus 100 or the external terminal 150.

Figure 3:
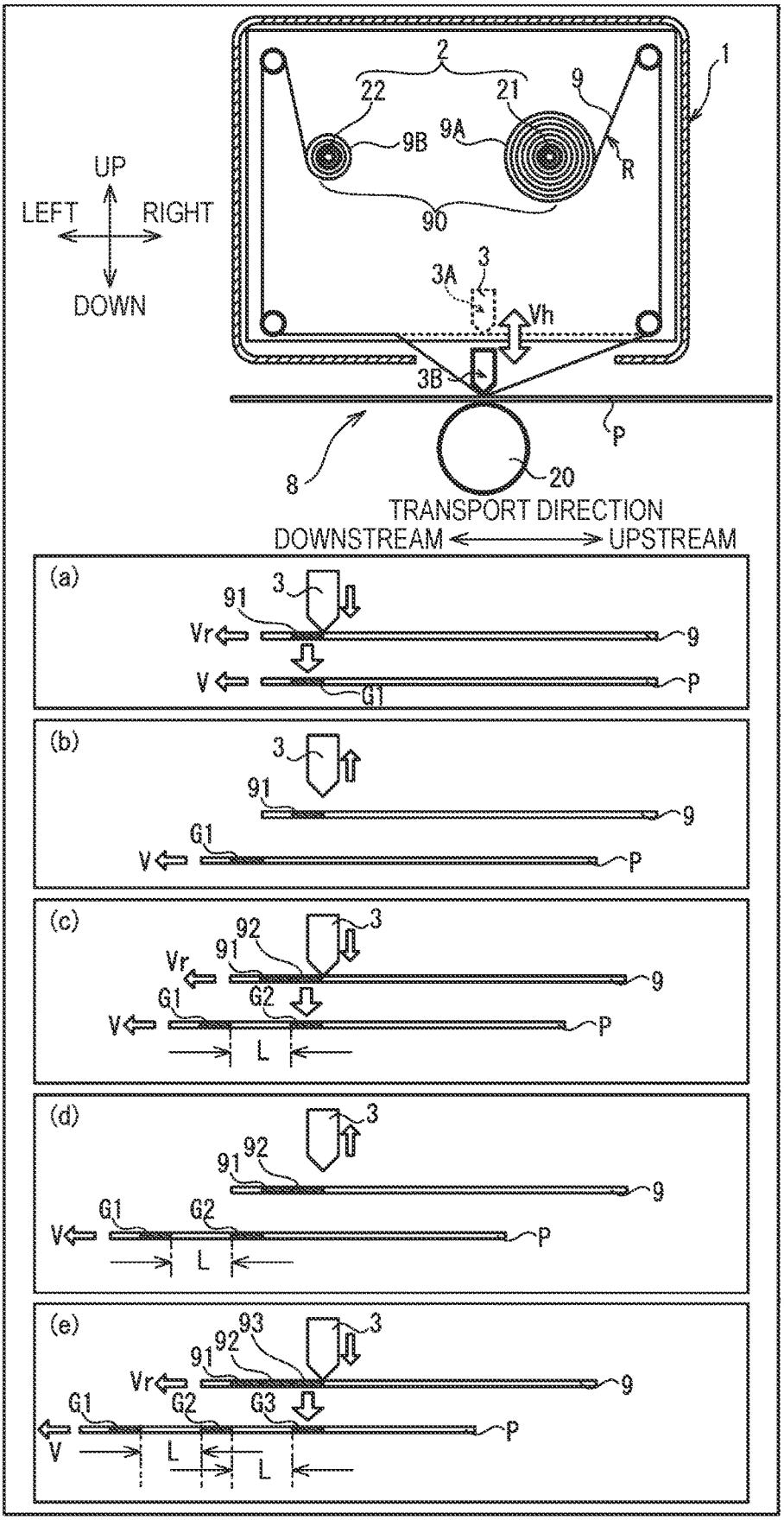
FIG. 3 is a diagram for explaining a printing operation in the printing system.

After the head lowering control and the ribbon acceleration control are completed, as illustrated in (a) of FIG. 3, the ink ribbon 9 is transported downstream at the ribbon speed Yr. The thermal head 3 moves relative to the ink ribbon 9 upstream while contacting a use area 91 of the ink ribbon 9. That is, the relative position between a heating position of the thermal head 3 and the ink ribbon 9 in the transport direction is changed by the transport of the ink ribbon 9. In this case, based on the print data set in the storage unit 71, the thermal head 3 is heated by energization. Ink in the use area 91 of the ink ribbon 9 is transferred to the printing surface of the print medium P. Thus, a print image G1 for one block is formed on the print medium P.

After the print image G1 is formed as illustrated in (a) of FIG. 3, heating of the thermal head 3 is stopped, and head raising control and ribbon deceleration control are executed. As illustrated in (b) of FIG. 3, in the head raising control, the thermal head 3 is moved from the head position 3B to the head position 3A at the head speed Vh (see FIG. 8) corresponding to the head speed setting set in the storage unit 71. In the ribbon deceleration control, the transport speed of the ink ribbon 9 is reduced from the ribbon speed Vr to zero. By stopping the rotation of the first spool 21 and the second spool 22, the transport of the ink ribbon 9 is stopped. Thus, the printing operation of the print image G1 is completed. The print medium P is continuously transported by the external apparatus 100 at the medium speed V.

Thereafter, the printing operation for the next one block is started. That is, in the printing device 1, when the print command is received from the external apparatus 100, the head lowering control and the ribbon acceleration control are executed while the print medium P is transported by the preparation distance L. With this configuration, as illustrated in (c) of FIG. 3, the thermal head 3 moves from the head position 3A to the head position 3B, and the ink ribbon 9 is transported to downstream at the ribbon speed Yr. The thermal head 3 moves upstream relative to the ink ribbon 9 while contacting the use area 92 of the ink ribbon 9. The thermal head 3 is heated, and the ink in the use area 92 of the ink ribbon 9 is transferred to the printing surface of the print medium P. Thus, a print image G2 is formed on the print medium P.

After the print image G2 is formed as illustrated in (c) of FIG. 3, heating of the thermal head 3 is stopped, and the head raising control and the ribbon deceleration control are executed. With this configuration, as illustrated in (d) of FIG. 3, the thermal head 3 is moved from the head position 3B to the head position 3A, and the transport of the ink ribbon 9 is stopped. Thus, the printing operation of the print image G2 is completed. Similarly to the matters described above, as illustrated in (e) of FIG. 3, the printing operation for the next one block is executed, and a print image G3 is formed on the print medium P.

The printing device 1 repeats the printing operation for each block described above a prescribed number of times in accordance with a print command from the external apparatus 100. From this, print images G1, G2, G3, . . . are formed on the print medium P. That is, heating is performed, by the thermal head 3 whose position in the transport direction does not move, with respect to the ink ribbon 9 transported downstream at the medium speed V. From this, a print image is formed on the print medium P transported downstream at the medium speed V.

<Main Process>

A main process of the printing device 1 will be described with reference to FIGS. 4 and 5. The controller 7 of the printing device 1 starts the main process by reading and executing the program stored in the storage unit 71 in response to the printing apparatus 1 being turned on.

Figure 4:
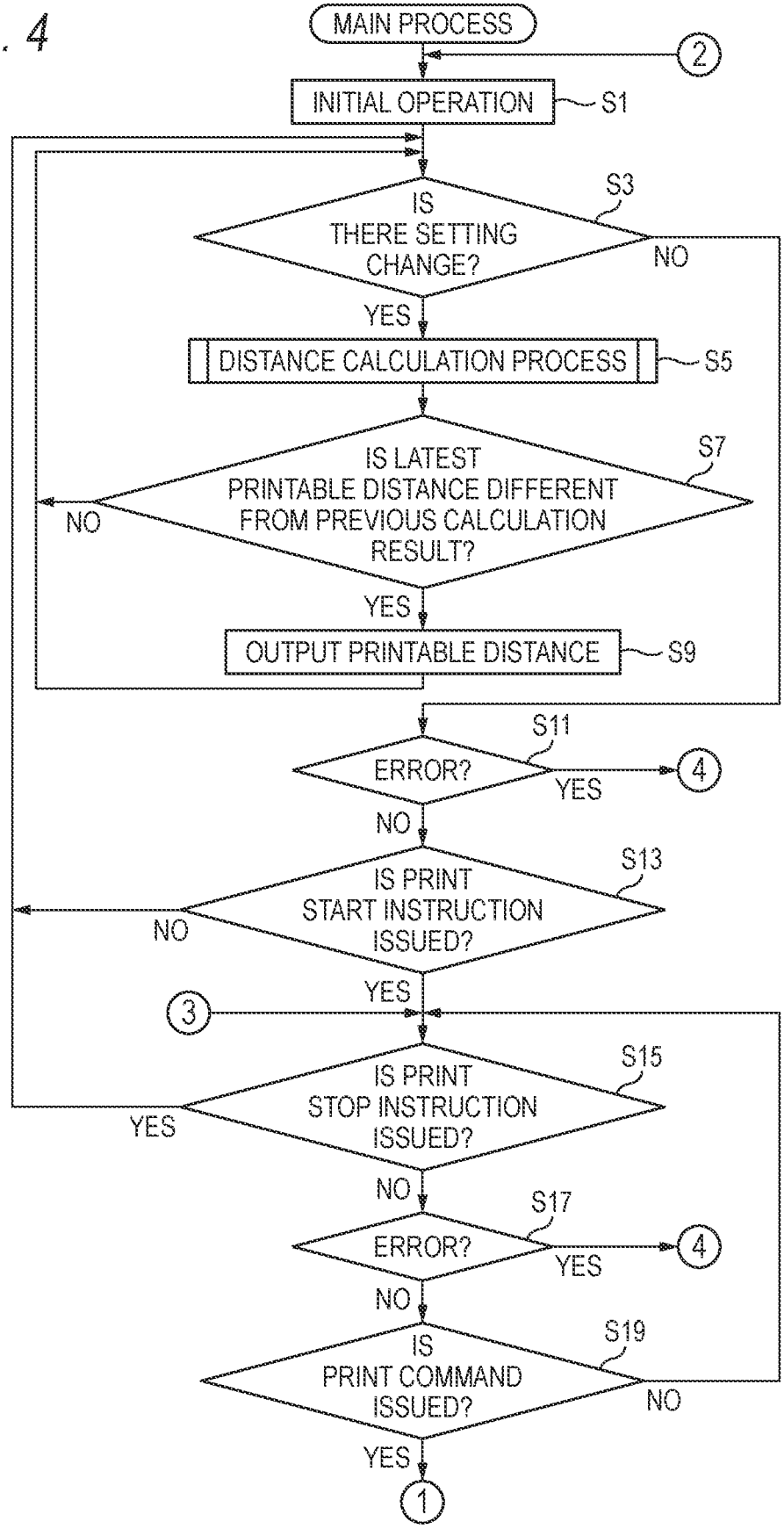
FIG. 4 is a flowchart of a main process.
Figure 5:
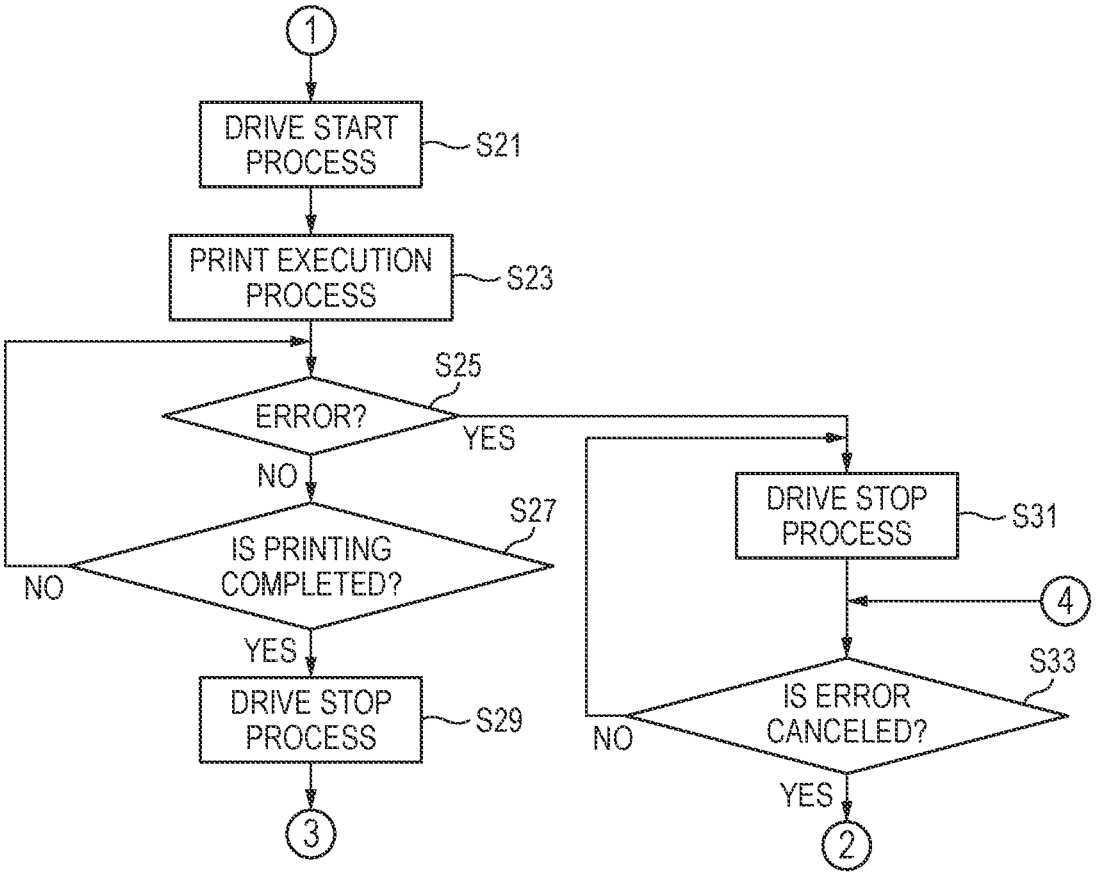
FIG. 5 is another flowchart of the main process.

As illustrated in FIG. 4, first, the controller 7 executes an initial operation (S1). The initial operation is a process of controlling the printing device 1 in an initial state. Specifically, the controller 7 executes an operation of moving the thermal head 3 to the head position 3A and an operation of detecting a roll diameter of each of the supply roll 9A and the winding roll 9B using a sensor that detecting the number of rotations of the guide shaft 61.

Next, the controller 7 determines whether there is a setting change (S3). As an example, when an instruction to change the ribbon type and the head speed setting is issued from the external apparatus 100, the external terminal 150, or the operation unit 73 of the printing device 1, the controller 7 determines that there is a setting change (YES in S3). In this case, the controller 7 executes a distance calculation process for calculating a printable distance (S5). The printable distance is a printable distance over which the print medium P is transported between the reception of the print command and the completion of the head movement control and the ribbon acceleration control. Details of the distance calculation process will be described later.

Next, the controller 7 determines whether the latest printable distance calculated in S5 is different from the previous calculation result of the printable distance stored in the storage unit 71 (S7). When it is determined that the calculated printable distance is the same as the previous calculation result, the controller 7 does not determine that the latest printable distance is different from the previous calculation result (NO in S7). In this case, the controller 7 returns the process to S3.

On the other hand, when it is determined that the calculated printable distance is different from the previous calculation result, or when the previous calculation result is not stored in the storage unit 71, the controller 7 determines that the latest printable distance is different from the previous calculation result (YES in S7). In this case, the controller 7 outputs the calculated printable distance through the inter-apparatus controller 110 (S9). In detail, the controller 7 notifies the external apparatus 100 of the printable distance through the inter-apparatus controller 110. The controller 7 has not received an unprocessed print instruction to be executed during execution of S5 to S9. For that reason, the controller 7 calculates, at least before receiving the print command, the printable distance over which the print medium P is transported between the reception of the print command and the completion of the head lowering control and the ribbon acceleration control and outputs the calculated printable distance through the inter-apparatus controller 110. Thereafter, the controller 7 returns the process to S3.

When it is determined that there is no setting change (NO in S3), the controller 7 determines whether an error has occurred (S11). For example, when the ink ribbon 9 is not attached to the printing device 1 or when malfunction occurs in the printing device 1, the controller 7 determines that an error has occurred (YES in S11). In this case, the controller 7 shifts the process to S33.

When it is determined that an error has not occurred (NO in S11), the controller 7 determines whether a print start instruction is issued (S13). For example, when a print start instruction is input from the external terminal 150, the external apparatus 100, or the operation unit 73 of the printing device 1, the controller 7 determines that the print start instruction is issued (YES in S13). In this case, the controller 7 controls the printing device 1 to be in a printable standby state. When it is determined that no print start instruction is issued (NO in S13), the controller 7 returns the process to S3.

When it is determined that the print start instruction is issued (YES in S13), the controller 7 determines whether a print stop instruction is issued (S15). For example, when the print stop instruction is input from the external terminal 150, the external apparatus 100, or the operation unit 73 of the printing device 1, the controller 7 determines that the print stop instruction is issued (YES in S15). In this case, the controller 7 controls the printing device 1 to be in a stop state, and returns the process to S3.

When it is determined that no print stop instruction is issued (NO in S15), the controller 7 determines whether an error has occurred similarly to S11 (S17). When it is determined that an error has occurred (YES in S17), the controller 7 shifts the process to S33. When it is determined that an error has not occurred (NO in S17), the controller 7 determines whether a print command is issued from the external apparatus 100 (S19). When it is determined that no print command is issued (NO in S19), the controller 7 returns the process to S15.

When it is determined that the print command is issued (YES in S19), the controller 7 executes a drive start process (S21). In the drive start process, the head lowering control and the ribbon acceleration control are executed. With this configuration, the thermal head 3 is moved from the head position 3A to the head position 3B, and the transport speed of the ink ribbon 9 is accelerated from zero to the ribbon speed Yr. That is, when the print command is received, the controller 7 executes the head lowering control for moving the thermal head 3 from the head position 3A to the head position 3B by the third motor 83 and the ribbon acceleration control that accelerates the transport speed of the ink ribbon 9 to the target speed (ribbon speed Vr) by the first motor 81 and the second motor 82.

Next, the controller 7 executes a print execution process (S23). In the print execution process, the thermal head 3 is heated by energization to form a print image for one block on the print medium P transported at the medium speed V, using the ink ribbon 9 transported at the ribbon speed Yr. That is, after the head lowering control and the ribbon acceleration control are completed, the controller 7 controls the thermal head 3 located at the head position 3B so as to perform printing on the print medium P, which is being transported and is disposed between the ink ribbon 9 and the platen roller 20, using the ink ribbon 9 transported at the target speed (ribbon speed Vr) by the first motor 81 and the second motor 82.

The controller 7 determines whether an error has occurred similarly to S11, during execution of the print execution process (S25). When it is determined that an error has not occurred (NO in S25), the controller 7 determines whether printing for one block based on the print command has been completed (S27). When it is determined that printing for one block is not completed (NO in S27), the controller 7 returns the process to S25.

When it is determined that printing for one block is completed (YES in S27), the controller 7 executes a drive stop process (S29). In the drive stop processing, head raising control and ribbon deceleration control are executed. With this configuration, energization of the thermal head 3 is interrupted, the thermal head 3 is moved from the head position 3B to the head position 3A, and the transport speed of the ink ribbon 9 is reduced from the ribbon speed Vr to zero. Thereafter, the controller 7 returns the process to S15 to wait for the print stop instruction or the next print command.

When it is determined that an error has occurred (YES in S25), the controller 7 executes the drive stop process similarly to S29 (S31). In this case, the controller 7 determines whether or not the error is canceled (S33). For example, when it is determined that the error is canceled by the user's operation or the like, the controller 7 determines that the error is canceled (YES in S33). In this case, the controller 7 returns the process to S1. When it is determined that no error is canceled (NO in S33), the controller 7 returns the process to S31.

<Distance Calculation Process>

A distance calculation process will be described with reference to FIG. 6. In the following distance calculation process, the controller 7 calculates the printable distance based on the required time for head lowering control or the required time for ribbon acceleration control and the transport speed of the print medium P.

Figure 6:
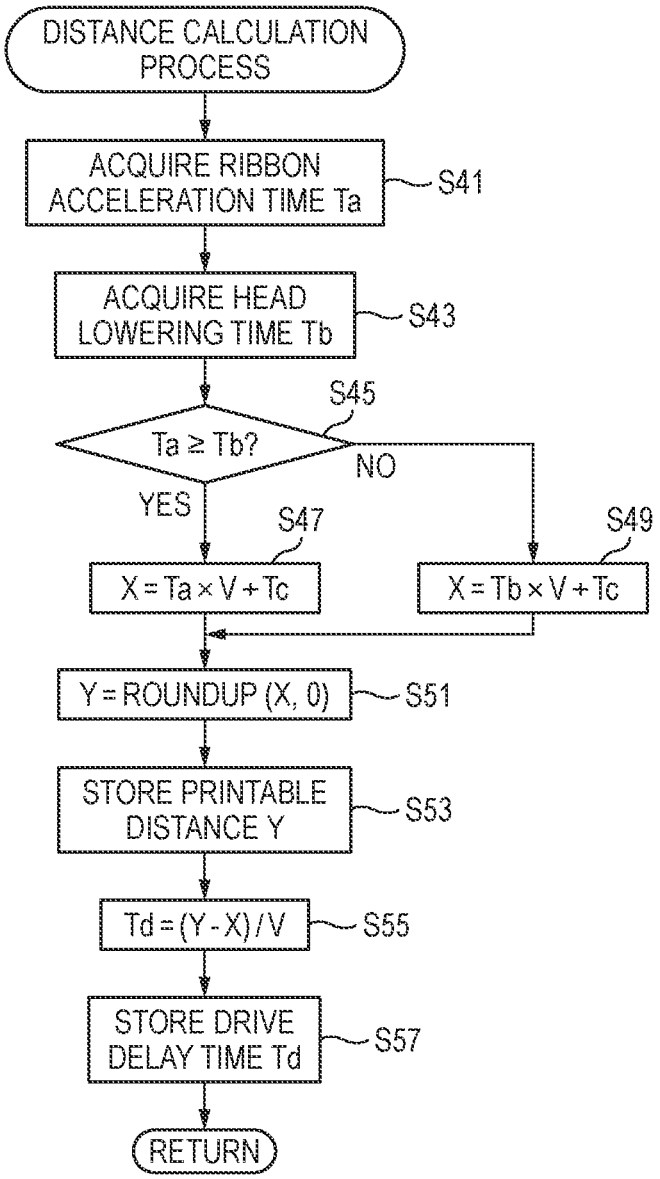
FIG. 6 is a flowchart of a distance calculation process.

As illustrated in FIG. 6, first, the controller 7 acquires a ribbon acceleration time Ta (S41). The ribbon acceleration time Ta is the time required for ribbon acceleration control, and is determined by the ribbon type of the ink ribbon 9 and the ribbon speed Vr corresponding to the medium speed V. As illustrated in FIG. 7, in the acceleration time table 30, the ribbon acceleration time Ta is determined according to a combination of the ribbon type and the ribbon speed Yr. When the ribbon speed Vr is the same, the greater the width and the length of the ink ribbon 9, the longer the ribbon acceleration time Ta. When the ribbon type is the same, the greater the ribbon speed Vr, the longer the ribbon acceleration time Ta. In S41, the controller 7 refers to the acceleration time table 30 to acquire the ribbon acceleration time Ta corresponding to the combination of the ribbon type and the ribbon speed Vr set in the storage unit 71.

Next, the controller 7 acquires a head lowering time Tb (S43). The head lowering time Tb is the required time for head lowering control. In this present embodiment, an elevation distance H (see FIG. 1) in which the thermal head 3 moves between the head positions 3A and 3B is constant, and as an example, the elevation distance H is "1.0 mm". Accordingly, the head lowering time Tb is determined by the head speed Vh. As illustrated in FIG. 8, in the head movement speed table 40, the correspondence between head speed setting and the head speed Vh is determined. In step S43, the controller 7 refers to the head movement speed table 40 to acquire the head speed Vh corresponding to the head speed setting set in the storage unit 71. The controller 7 acquires a value obtained by dividing the elevation distance H by the head speed Vh as the head lowering time Tb.

Next, the controller 7 determines whether the ribbon acceleration time Ta is equal to or greater than the head lowering time Tb (S45). When it is determined that the ribbon acceleration time Ta is equal to or greater than the head lowering time Tb (YES in S45), the controller 7 calculates a printable distance X by the following (Equation 1) (S47). The printable distance X represents the distance over which the print medium P is transported from reception of the print command to completion of both the head lowering control and the ribbon acceleration control in units of 1 mm.

$$X=Ta\cdot V+C \quad \text{(Equation 1)}$$

As such, when the required time for ribbon acceleration control is equal to or greater than the required time for head lowering control, the controller 7 calculates the printable distance based on the required time for ribbon acceleration control and the transport speed of print medium P.

When it is determined that the ribbon acceleration time Ta is less than the head lowering time Tb (NO in S45), the controller 7 calculates the printable distance X by the following (Equation 2) (S49). Where "V" is the medium speed V set in the storage unit 71, and "C" is a standby distance C of a specified value (for example, 0.1 mm), in (Equation 1) and (Equation 2).

$$X=Tb\cdot V+C \quad \text{(Equation 2)}$$

As such, when the required time for ribbon acceleration control is less than the required time for head lowering control, the controller 7 calculates the printable distance based on the required time for head lowering control and the transport speed of the print medium P.

Next, when the calculated printable distance X has a fraction after the decimal point, the controller 7 acquires a printable distance Y obtained by rounding up the fraction (S51). That is, the printable distance Y represents the distance, over which the print medium P is transported from when the print command is received to when both the head lowering control and the ribbon acceleration control are completed, as an integer value in millimeter units obtained by rounding up digits after the decimal point. The controller 7 stores the acquired printable distance Y in the storage unit 71 as the latest printable distance (S53).

Next, the controller 7 calculates a drive delay time Td by the following (Equation 3) (S55). The drive delay time Td is a delay time that delays the start timing of the head lowering control and the ribbon acceleration control from the time of reception of the print command Where "V" is the medium speed V set in the storage unit 71, "Y" is the latest printable distance Y acquired in S53, and "X" is the printable distance X before rounding up digits after the decimal point, in SM.

$$Td=(Y-X)/V \quad \text{(Equation 3)}$$

The controller 7 stores the calculated drive delay time Td in the storage unit 71 (S57), and returns the process to the main process.

In the main process illustrated in FIG. 4, the controller 7 notifies the external apparatus 100 of the printable distance Y stored in the storage unit 71 as the latest printable distance (S9). That is, when a fraction occurs in the calculated printable distance X, the controller 7 outputs the printable distance Y of a value, which is obtained by rounding up the fraction, through the inter-apparatus controller 110. The controller of the external apparatus 100 displays the received printable distance Y on a display unit of the external apparatus 100. Accordingly, the user can recognize the printable distance Y in the external apparatus 100. When the user sets the preparation distance L in the external apparatus 100, the user sets the preparation distance L to be the printable distance Y or more. With this configuration, when the printing device 1 executes printing according to the print command, both the head lowering control and the ribbon acceleration control are completed when the print medium P is transported by the preparation distance L from the time of reception of the print command. Accordingly, the printing device 1 can appropriately form a print image on the print medium P.

Every time the ribbon type or head speed setting is changed in the printing device 1, the external apparatus 100 or the external terminal 150, a new printable distance Y according to the contents of the change is calculated and transmitted to the external apparatus 100 (YES in S3 and S5 to S9). Accordingly, even when the user changes the ribbon type and the head speed setting, the user can set the optimum preparation distance L in the external apparatus 100 according to the contents of the change.

<Details of Printing Operation>

Figure 9:
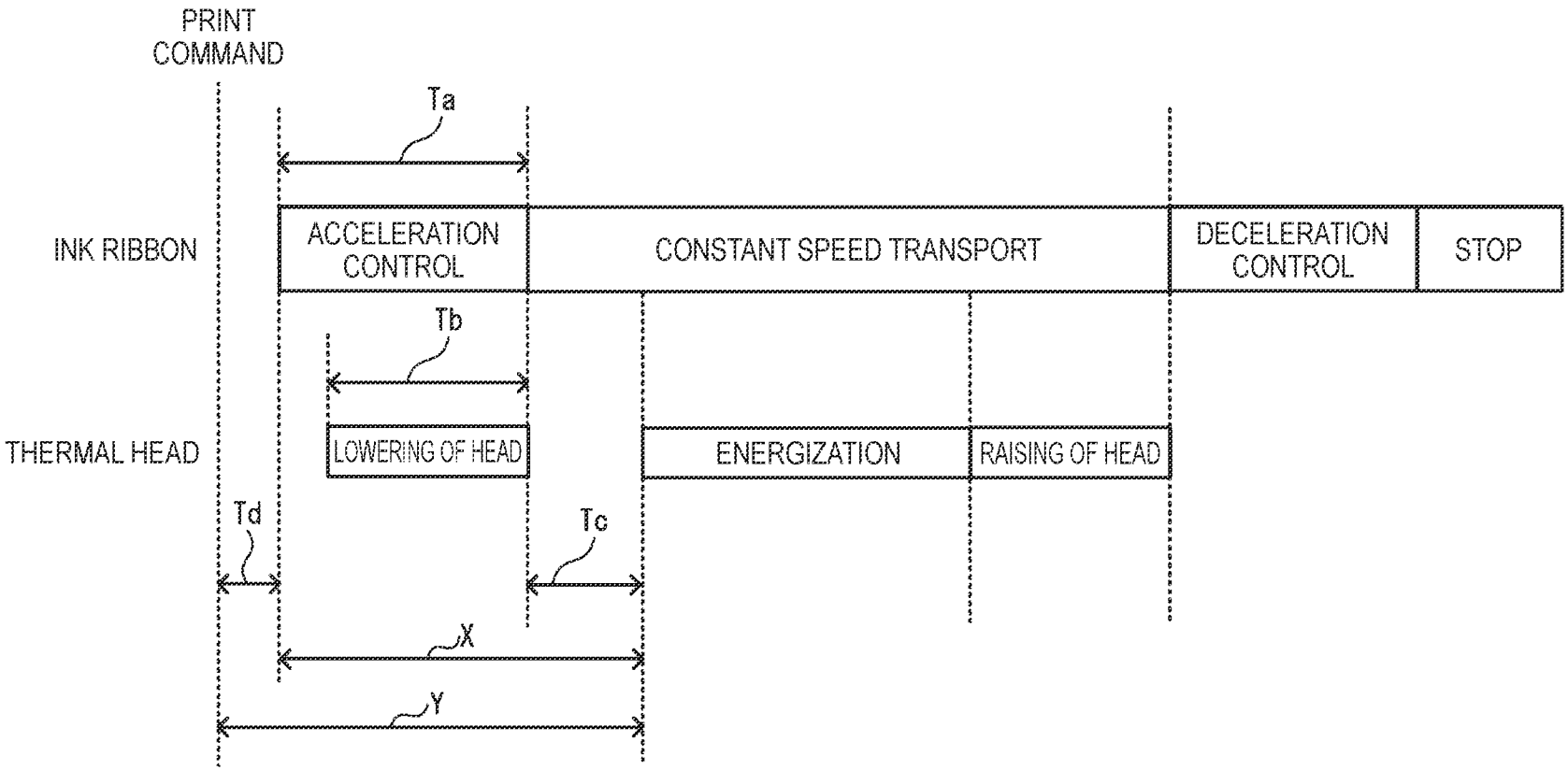
FIG. 9 is a diagram for explaining a flow of a printing operation for one block.
Figure 10:
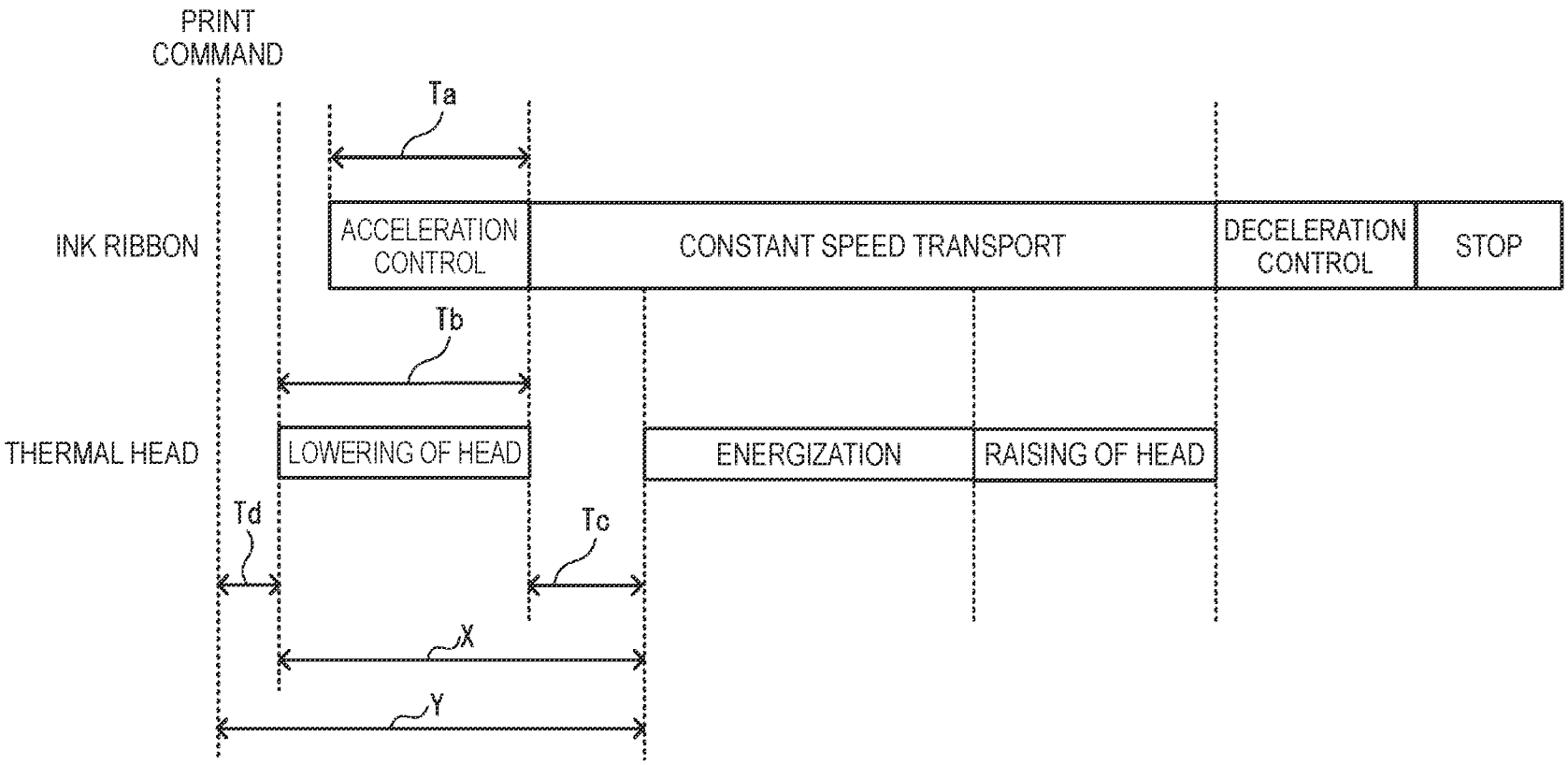
FIG. 10 is another diagram for explaining the flow of the printing operation for one block.

Details of the printing operation for one block will be described with reference to FIGS. 9 and 10. In FIGS. 9 and 10, a standby time Tc is a value obtained by dividing the standby distance C (for example, 0.1 mm) by the medium speed V. FIG. 9 and FIG. 10 illustrate flows from the start to the end of the printing operation for one block in response to the reception of the print command. The preparation distance L instructed by the print command is equal to the printable distance Y notified to the external apparatus 100 before the print command is received.

In the example illustrated in FIG. 9, a case where the ribbon acceleration time Ta is longer than the head lowering time Tb is exemplified. In this case, in the distance calculation process (see FIG. 6), the printable distance X is calculated based on the (Equation 1) described above, and the printable distance Y and the drive delay time Td are calculated (S47 and S51 to S57). In the drive start process (S21), the ribbon acceleration control is started when the drive delay time Td elapses from the time of reception of the print command. When the difference time between the ribbon acceleration time Ta and the head lowering time Tb has elapsed counting from the start of the ribbon acceleration control, the head lowering control is started. With this configuration, the ribbon acceleration control and the head lowering control are completed at the same timing. That is, when rounding up the fraction of the calculated printable distance X, the controller 7 delays the start timing of the head lowering control and the ribbon acceleration control according to the transport time (drive delay time Td) of the print medium P corresponding to the rounded-up amount of the fraction.

Next, in the print execution process (S23), the ink ribbon 9 is transported at a constant speed at the ribbon speed Vr, but energization of the thermal head 3 is on standby until the standby time Tc elapses from the time of completion of the ribbon acceleration control and the head lowering control. On the other hand, when the standby time Tc has elapsed from the time of completion of the ribbon acceleration control and the head lowering control, the total time of the drive delay time Td, the ribbon acceleration time Ta, and the standby time Tc has elapsed counting from the time of reception of the print command. In this case, since the print medium P has been transported by the printable distance Y, energization of the thermal head 3 is started and printing on the print medium P is started.

Thereafter, when a print image for one block is formed, in the drive stop process (S29), energization of the thermal head 3 is ended first, then the head raising control is executed, and finally the ribbon deceleration control is executed, and the printing operation for one block is completed.

In the example illustrated in FIG. 10, a case where the head lowering time Tb is longer than the ribbon acceleration time Ta is exemplified. In this case, in the distance calculation process (see FIG. 6), the printable distance X is calculated based on the (Equation 2) described above, and the printable distance Y and the drive delay time Td are calculated (S49 and S51 to S57). In the drive start process (S21), when the drive delay time Td elapses from the time of reception of the print command, the head lowering control is started. When the difference time between the ribbon acceleration time Ta and the head lowering time Tb has elapsed counting from the start of the head lowering control, the ribbon acceleration control is started. With this configuration, the ribbon acceleration control and the head lowering control are completed at the same timing. That is, similarly to the case of FIG. 9, the controller 7 delays the start timing of the head lowering control and the ribbon acceleration control according to the drive delay time Td.

Next, in the print execution process (S23), when the standby time Tc elapses from the completion of the ribbon acceleration control and the head lowering control, the total time of the drive delay time Td, the head lowering time Tb, and the standby time Tc has elapsed counting from the time of reception of the print command. In this case, since the print medium P has been transported by the printable distance Y, energization of the thermal head 3 is started and printing on the print medium P is started. Thereafter, when a print image for one block is formed, the printing operation for one block is ended in the drive stop process (S29).

According to the printing operation illustrated in FIGS. 9 and 10, in consideration of the difference between the printable distance X and the printable distance Y, the ribbon acceleration control and the head lowering control are started after the drive delay time Td has elapsed from the time of reception of the print command With this configuration, the printing device 1 can accurately start printing on the print medium P from the point in time when the print medium P has been transported by the printable distance Y counting from the time of reception of the print command.

Of the ribbon acceleration control and the head lowering control, the control with longer required time is started first. The control with longer required time and the control with shorter required time are completed at the same timing. With this configuration, it is possible to suppress the time required for completion of both the ribbon acceleration control and the head lowering control, and hence the time required for the printing operation for one block.

Vibration may occur in the printing device 1 due to acceleration of the ink ribbon 9 by the ribbon acceleration control or movement of the thermal head 3 by the head lowering control. In a state where vibration occurs in the printing device 1, the print position of the thermal head 3 may be blurred, which may deteriorate printing quality. In this embodiment, after execution of the ribbon acceleration control and the head lowering control, the standby time Tc during which energization of the thermal head 3 is on standby is provided. Even when vibration occurs in the printing device 1, vibration of the printing device 1 is settled within the standby time Tc, and thus good print quality can be maintained.

<Example of Action of Embodiment>

According to the printing system 8 of this embodiment, the ink ribbon 9 is transported through a space between the thermal head 3 and the platen roller 20. The thermal head 3 is moved between the head position 3B at which the ink ribbon 9 is urged toward the platen roller 20 and the head position 3A which is farther away from the platen roller 20 compared with the head position 3B to release urging of the ink ribbon against the platen roller. When receiving the print command, the controller 7 executes the head lowering control and the ribbon acceleration control (S21). After completion of the head lowering control and the ribbon acceleration control, the controller 7 controls the thermal head 3 located at the head position 3B so as to perform printing on the print medium P, which is being transported and is disposed between the ink ribbon 9 and the platen roller 20, using the ink ribbon 9 transported at the ribbon speed Vr (S23). The controller 7 outputs the printable distance, over which the print medium is transported between the reception of the print command and the completion of the head lowering control and the ribbon acceleration, through the inter-apparatus controller 110 at least before receiving the print command (S9).

According to this, when the user of the printing system 8 sets the distance for transporting the print medium P from the issuance of the print command to the start of printing, the user can set the distance to a distance equal to or greater than the printable distance output through the inter-apparatus controller 110. If the set distance is equal to or greater than the printable distance, the head lowering control and the ribbon acceleration control have been completed when the print medium P is transported by the set distance, and thus the printing device 1 is in a state where printing can be appropriately executed. Accordingly, it can be suppressed that the user has to set the distance again.

The controller 7 calculates the printable distance based on the required time for head lowering control or the required time for ribbon acceleration control and the transport speed of the print medium P (S5). According to this, it is possible to accurately calculate the printable distance so as to be the shortest transport distance of the print medium P from when the printing device 1 receives the print command to when the printing device 1 can actually print.

When the required time for ribbon acceleration control is equal to or greater than the required time for head lowering control, the controller 7 calculates the printable distance Y based on the required time for ribbon acceleration control and the transport speed of print medium P (S47 and S51). According to this, it is possible to accurately calculate the printable distance based on the required time for the ribbon acceleration which is a longer required time than the head lowering control.

When the required time for ribbon acceleration control is less than the required time for head lowering control, the controller 7 calculates the printable distance X based on the required time for head lowering control and the transport speed of the print medium P (S49 and SM). According to this, it is possible to accurately calculate the printable distance based on the required time for the head lowering control which has a longer required time than the ribbon acceleration control.

When a fraction occurs in the calculated printable distance X, the controller 7 outputs the printable distance Y of a value obtained by rounding up the fraction, through the inter-apparatus controller 110 (SM, S53, and S9). According to this, the printable distance Y output through the inter-apparatus controller 110 is an integer value. For that reason, the user can easily set the distance for transporting the print medium P from the issuance of the print command to the start of printing based on the printable distance Y easier to recognize than the printable distance X.

When rounding up the fraction of the calculated printable distance X, the controller 7 delays the start timing of the head lowering control and the ribbon acceleration control according to the transport time of the print medium P corresponding to the rounded-up amount of the fraction (S21). According to this, the printable distance Y output through the inter-apparatus controller 110 is slightly longer than the more accurate printable distance X. It is possible to absorb the difference between the printable distance Y and the printable distance X at the start of the printing operation by delaying the start timings of the head lowering control and the ribbon acceleration control according to the transport time of the print medium P corresponding to the rounded-up amount of the printable distance X. Compared to the case where such a delay process is not performed, it is possible to suppress that the unused ink ribbon 9 is transported between the completion of the ribbon acceleration control and the start of energization of the thermal head 3, and to enhance use efficiency of the ink ribbon 9.

<Others>

In the embodiment described above, the controllers 7 and 111 are examples of the "controller" in the present invention. The inter-apparatus controller 110 is an example of the "interface" in the present invention. The first motor 81 and the second motor 82 are examples of the "ribbon drive source" in the present invention. The third motor 83 is an example of the "head drive source" in the present invention. The present invention is not limited to the embodiment described above, and various alterations are possible.

The timing at which the external apparatus 100 transmits a print command to the printing device 1 can be arbitrarily set in the external apparatus 100. For example, the external apparatus 100 may include a sensor that detects, at a predetermined position, a plurality of sensor marks printed on the print medium P at intervals in the length direction. In this case, the external apparatus 100 may transmit the print command to the printing device 1 when the sensor detects a sensor mark from the print medium P being transported.

In the embodiment described above, the controller 7 of the printing device 1 executes the main process (see FIGS. 4 and 5), but the controller 111 of the inter-apparatus controller 110 may execute a part or all of the main process. For example, the controller 111 may execute a process (S3 to S9) regarding calculation and output of the printable distance in the main process.

In the printing system 8, when the printing device 1 is connected to the external apparatus 100 and the external terminal 150 not through the inter-apparatus controller 110, the inter-apparatus controller 110 may not be provided. In this case, the controller 7 of the printing device 1 may execute the process to be executed by the controller 111 of the inter-apparatus controller 110. In the printing system 8, when the controller 111 of the inter-apparatus controller 110 can execute the process to be executed by the controller 7 of the printing device 1, the controller 7 of the printing device 1 may not be provided.

The controller 7 may output the printable distance immediately after the main process is started regardless of whether or not there is a setting change (S9). In this case, the controller 7 may execute the distance calculation process (S5) to calculate the printable distance, or may output the previous calculation result of the printable distance stored in the storage unit 71.

In the embodiment described above, the case where the controller 7 outputs the printable distance to the external apparatus 100 through the inter-apparatus controller 110 in S9 of the main process is exemplified. Instead of this, the controller 7 may output the printable distance to the external terminal 150 or the operation unit 73 of the printing device 1. When the inter-apparatus controller 110 includes a display unit, the controller 7 may output the printable distance to the display unit of the inter-apparatus controller 110.

In the embodiment described above, the case where the controller 7 outputs the printable distance Y rounded up in S9 of the main process is exemplified. Instead of this, the controller 7 may output the printable distance X before being rounded up. In this case, the standby distance C is unnecessary in (Equation 1) and (Equation 2). Calculation of the drive delay time Td (S55 and S57) and drive delay control based on the drive delay time Td (see FIGS. 9 and 10) can be omitted.

In the distance calculation process (S5), the standby distance C is not limited to 0.1 mm, and may be another numerical value. The standby distance C is not limited to a fixed value, and may be a numerical value changed according to, for example, the medium speed V.

In the embodiment described above, the printable distance is calculated. Instead of this, the printable distance may be determined by referring to a data table.

According to the printing system of this aspect, the ink ribbon is transported through a space between the thermal head and the platen roller. The thermal head is moved between a first position at which the ink ribbon is urged toward the platen roller and a second position which is farther away from the platen roller than the first position and at which urging of the ink ribbon against the platen roller is released. When receiving the print command, the controller executes head movement control for moving the thermal head from the second position to the first position and ribbon acceleration control for accelerating the transport speed of the ink ribbon to a target speed. After completion of the head movement control and the ribbon acceleration control, the controller controls the thermal head located at the first position to perform printing on the print medium which is being transported and is disposed between the ink ribbon and the platen roller using the ink ribbon transported at the target speed. The controller outputs, through an interface, a printable distance over which the print medium is transported between the reception of the print command and the completion of the head movement control and the ribbon acceleration control, at least before receiving the print command.

According to this, when the user of the printing system sets the distance for transporting the print medium from the issuance of the print command to the start of printing, the distance may be set to a distance greater than the printable distance output through the interface. If the set distance is equal to or greater than the printable distance, the head movement control and the ribbon acceleration control are completed when the print medium is transported by the set distance, and thus the printing apparatus is ready to print appropriately. Accordingly, it may be suppressed that the user has to set the distance again.

What is claimed is:

1. A printing system, comprising:

a printing device that includes:

a thermal head, a ribbon drive source that is configured to transport an ink ribbon through a space between the thermal head and a platen roller; and a head drive source that is configured to move the thermal head in a direction approaching or separating from the platen roller, the platen roller that is disposed opposite to the ink ribbon with respect to a transport path of a print medium transported by an external apparatus;

a controller; and an interface, wherein the head drive source is configured to move the thermal head between a first position at which the ink ribbon is urged toward the platen roller and a second position which is farther away from the platen roller than the first position and at which urging of the ink ribbon against the platen roller is released, when receiving a print command, the controller is configured to execute head movement control for moving the thermal head from the second position to the first position with the head drive source and ribbon acceleration control for accelerating a transport speed of the ink ribbon to a target speed with the ribbon drive source, after completion of the head movement control and the ribbon acceleration control, the controller is configured to control energization of the thermal head to be on standby until a standby time elapses from the time of completion of the ribbon acceleration control and the head movement control, and when the standby time has elapsed from the time of completion of the ribbon acceleration control and the head movement control, the controller is configured to control the thermal head located at the first position to perform printing on the print medium, which is being transported and is disposed between the ink ribbon and the platen roller, using the ink ribbon transported at the target speed with the ribbon drive source.

2. The printing system according to claim 1, wherein the controller is configured to determine the standby time based on a standby distance by which the printing medium is transported from completion of both the head movement control and the ribbon acceleration control to start of energization of the thermal head.

3. The printing system according to claim 2, wherein the controller is configured to determine the standby distance according to the transport speed of the printing medium.

* * * * *